US006273343B1

(12) United States Patent
Guo

(10) Patent No.: US 6,273,343 B1
(45) Date of Patent: Aug. 14, 2001

(54) SPRAYER HAVING A REINFORCING HEAD

(76) Inventor: Wen Li Guo, No. 10, Fang Dong Road, Wen Gin Tsuen, Fang Yuan Hsiang, Chang Hua Hsien, 528 (TW)

( * ) Notice: Subject to any disclaimer, the term of this patent is extended or adjusted under 35 U.S.C. 154(b) by 0 days.

(21) Appl. No.: 09/608,725

(22) Filed: Jun. 30, 2000

(51) Int. Cl.[7] ..... A62C 31/02
(52) U.S. Cl. ..... 239/394; 239/446; 239/526
(58) Field of Search ..... 239/443, 444, 239/446, 448, 449, 391, 394, 525, 526

(56) References Cited

U.S. PATENT DOCUMENTS

| | | | |
|---|---|---|---|
| 4,068,801 | 1/1978 | Leutheuser | 239/102 |
| 5,551,637 | 9/1996 | Lo | 239/394 |
| 5,566,886 | 10/1996 | Wang | 239/394 |
| 5,598,978 | 2/1997 | Wang | 239/394 |
| 5,823,442 * | 10/1998 | Guo | 239/394 |
| 5,873,531 * | 2/1999 | Wang | 239/526 X |
| 5,992,762 * | 11/1999 | Wang | 239/394 |
| 6,113,009 * | 9/2000 | Chih | 239/394 |
| 6,164,566 * | 12/2000 | Hui-Chen | 239/446 X |

* cited by examiner

*Primary Examiner*—David A. Scherbel
*Assistant Examiner*—Steven J. Ganey
(74) *Attorney, Agent, or Firm*—Charles E. Baxley

(57) ABSTRACT

A sprayer includes a housing rotatably secured onto a front portion of a handle. The housing has a peripheral wall and a peripheral partition and has a number of ports formed by a number of barrels. A cover is secured to the rear of the housing and engaged with the peripheral partition and has one or more slots. The barrels include an end extended beyond the peripheral partition and engaged into the slot of the cover for solidly securing the cover to the housing. The slot of the cover may be a curved slot for receiving two or more barrels.

6 Claims, 4 Drawing Sheets

SPRAYER HAVING A REINFORCING HEAD

BACKGROUND OF THE INVENTION

1. Field of the Invention

The present invention relates to a sprayer, and more particularly to a sprayer having a reinforced head.

2. Description of the Prior Art

Typical sprayers comprise a discharge head rotatably attached onto a handle and including a number of holes formed therein for discharging water. The handle includes an outlet formed therein for selectively coupling to either of the holes of the discharge head for selecting the required spraying nozzle. U.S. Pat. No. 4.068,801 to Leutheuser, U.S. Pat. No. 5,551,637 to Lo, and U.S. Pat. Nos. 5,566,886 and 5,598,978 to Wang disclose the typical sprayers having a head rotatably secured thereto. The discharge head includes a housing having the holes of various shapes formed therein, and a plate secured to the rear portion of the housing with the welding process, such as the ultrasonic welding process. The plate includes a number of orifices formed therein and communicating with the holes of the housing respectively for communicating the holes with the outlet of the handle. The housing normally includes a flat rear surface, and the plate includes a flat structure and engaged onto the flat rear surface of the housing, such that the plate may not be solidly secured to the housing.

The present invention has arisen to mitigate and/or obviate the afore-described disadvantages of the conventional sprayers.

SUMMARY OF THE INVENTION

The primary objective of the present invention is to provide a discharge head for a sprayer having a cover that may be solidly secured to the housing of the discharge head.

In accordance with one aspect of the invention, there is provided a sprayer comprising a sprayer body including a front portion having an outlet formed therein and including a rear portion, a housing rotatably secured to the front portion of the sprayer body at a pivot shaft, the housing including a rear portion having a peripheral wall and a peripheral partition extended therefrom and including a plurality of ports defined by a plurality of barrels respectively, and a cover secured to the rear portion of the housing and engaged with the peripheral partition of the housing, the cover including at least one slot formed therein. The barrels include a height greater than that of the peripheral partition of the housing aid include an end extended beyond the peripheral partition of the housing and engaged into the slot of the cover for solidly securing the cover to the housing.

The housing includes an annular channel formed and defined between the peripheral wall and the peripheral partition, the housing includes an annular groove formed therein and defined by an a cylindrical fence and the peripheral partition, the housing includes a front portion having a plurality of openings formed therein and communicating with the annular channel of the housing and having a plurality of apertures formed therein and communicating with the annular groove of the housing, the cover includes a first hole and a second hole formed therein the peripheral partition includes a duct extended radially inward of the housing and communicating with the first hole of the cover for coupling the openings and the annular channel of the housing to the outlet of the sprayer body, and the cylindrical fence includes a conduit communicating with the second hole of the cover for coupling the apertures and the annular groove of the housing to the outlet of the sprayer body, and for allowing the water to be guided to flow out of the housing via the openings and the apertures when the housing is rotated relative to the sprayer body.

The housing further includes a space formed therein and defined by a peripheral panel, and includes an annular chamber defined between the cylindrical fence and the peripheral panel, the peripheral panel includes a passage formed therein, the cover includes a third hole formed therein and communicating with the passage of the peripheral panel for guiding the water to flow into the space via the third hole.

The first and the second holes of the cover and the slot of the cover are arranged in a circle for aligning with the outlet of the sprayer body when the housing is rotated relative to the sprayer body. The peripheral wall of the housing has a height no less than that of the barrels for receiving the cover in the peripheral wall of the housing. The slot of the cover is a curved slot, the housing includes at least two of the barrels engaged into the curved slot of the cover.

Further objectives and advantages of the present invention will become apparent from a careful reading of a detailed description provided hereinbelow with appropriate reference to accompanying drawings.

DETAILED DESCRIPTION OF THE PREFERRED EMBODIMENT

Figure 1:
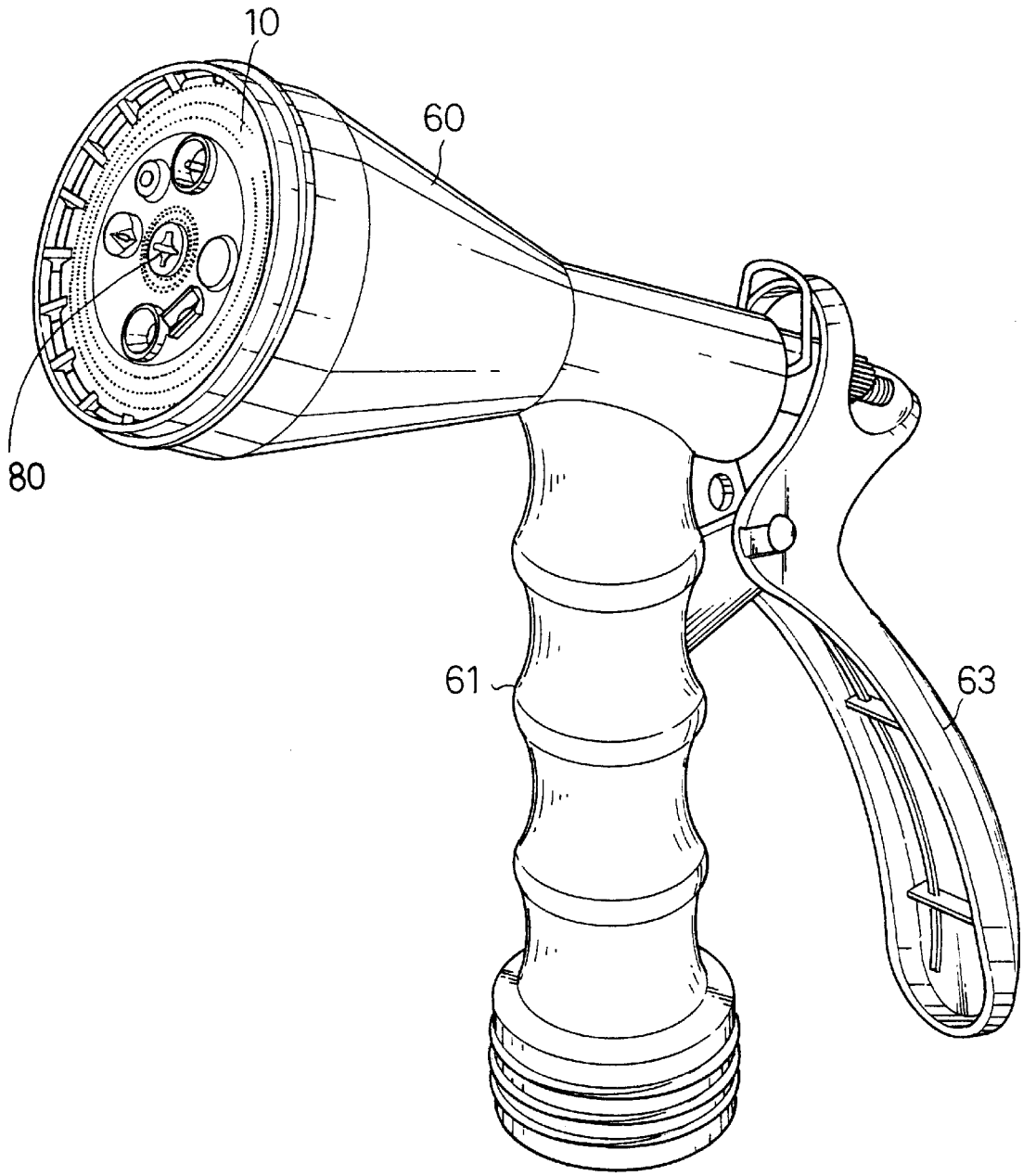
FIG. 1 is a perspective view of a sprayer having a discharge head in accordance with the present invention.
Figure 2:
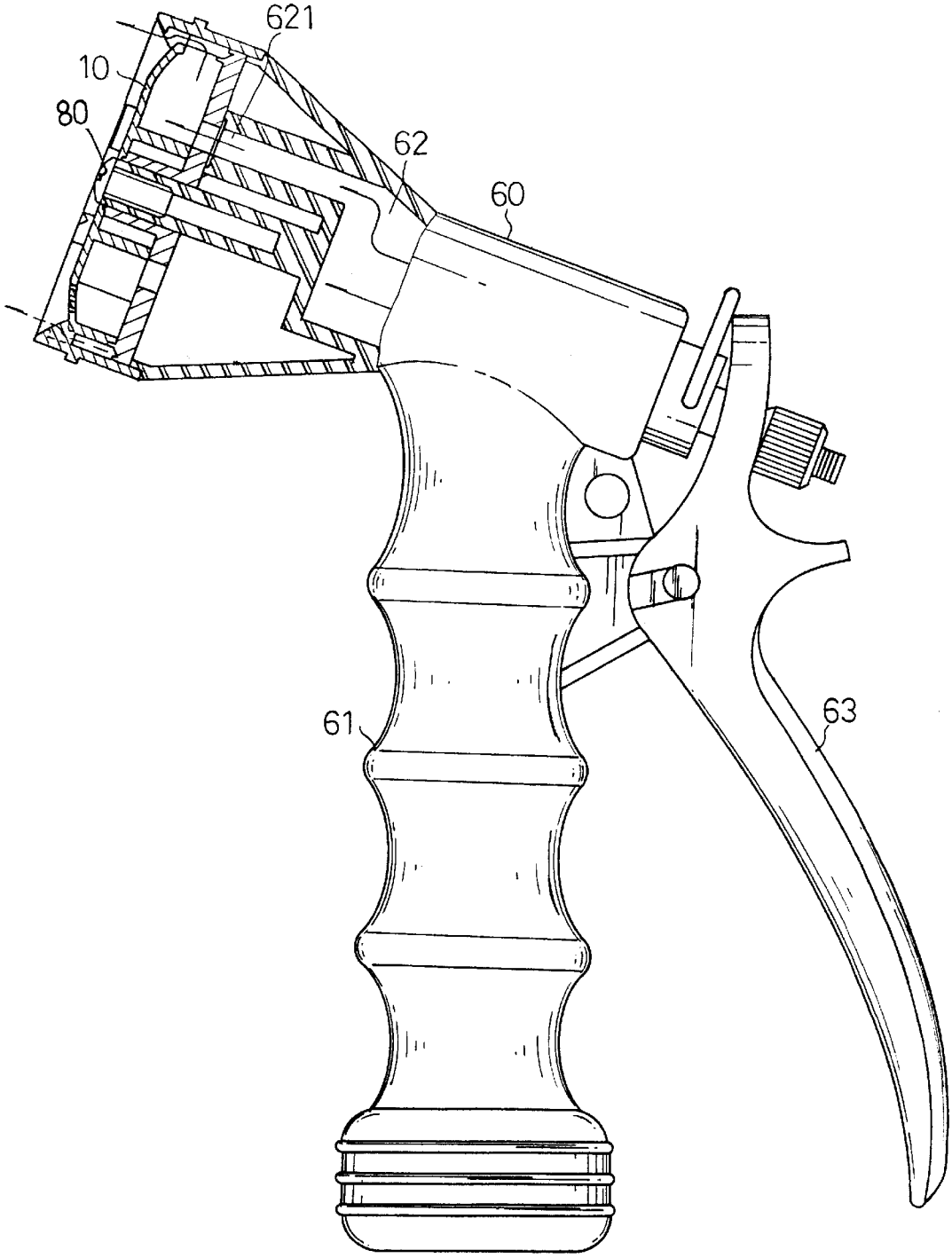
FIG. 2 is a plane view of the sprayer, in which the front portion of the sprayer is cut off for showing the inner structure of the discharge head.

Referring to the drawings, and initially to FIGS. 1 and 2, a sprayer in accordance with the present invention includes a discharge head having a housing 10 rotatably attaching onto a front portion of a sprayer body 60 at a pivot shaft 80 for allowing the housing of the discharge head to be rotated about the pivot shaft 80. The sprayer body 60 comprises a handle 61 having a lower end coupled to a water reservoir and having an upper end coupled to or communicating with a chamber 62 that is formed in the sprayer body 60. The sprayer body 60 includes an outlet 621 communicating with the chamber 62 of the sprayer body 60 for discharging the water and includes a hand grip 63 pivotally coupled thereto for actuating and controlling the water flowing through the chamber 62 of the sprayer body 60.

Figure 3:
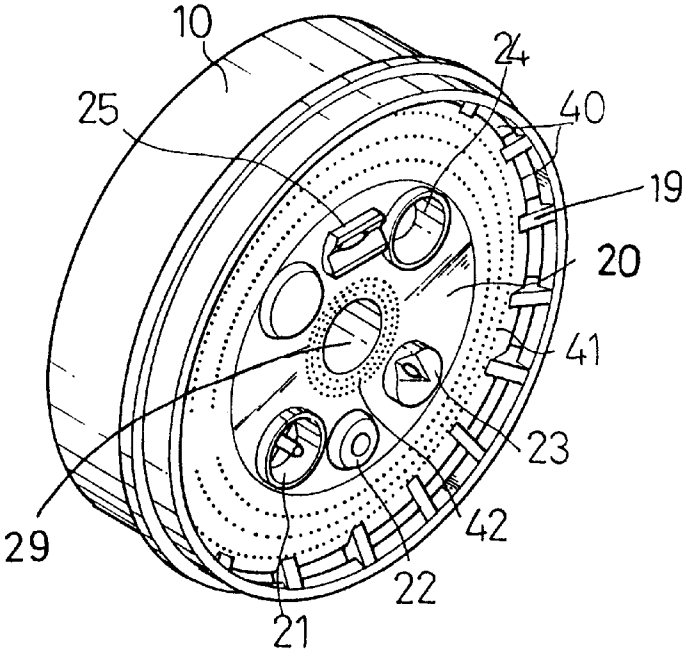
FIG. 3 is a front perspective view of the discharge head.
Figure 4:
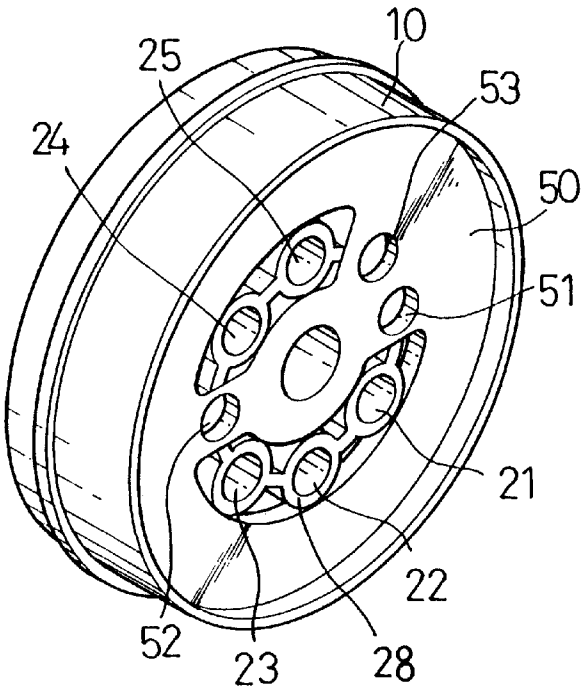
FIG. 4 is a rear perspective view of the discharge head.
Figure 5:
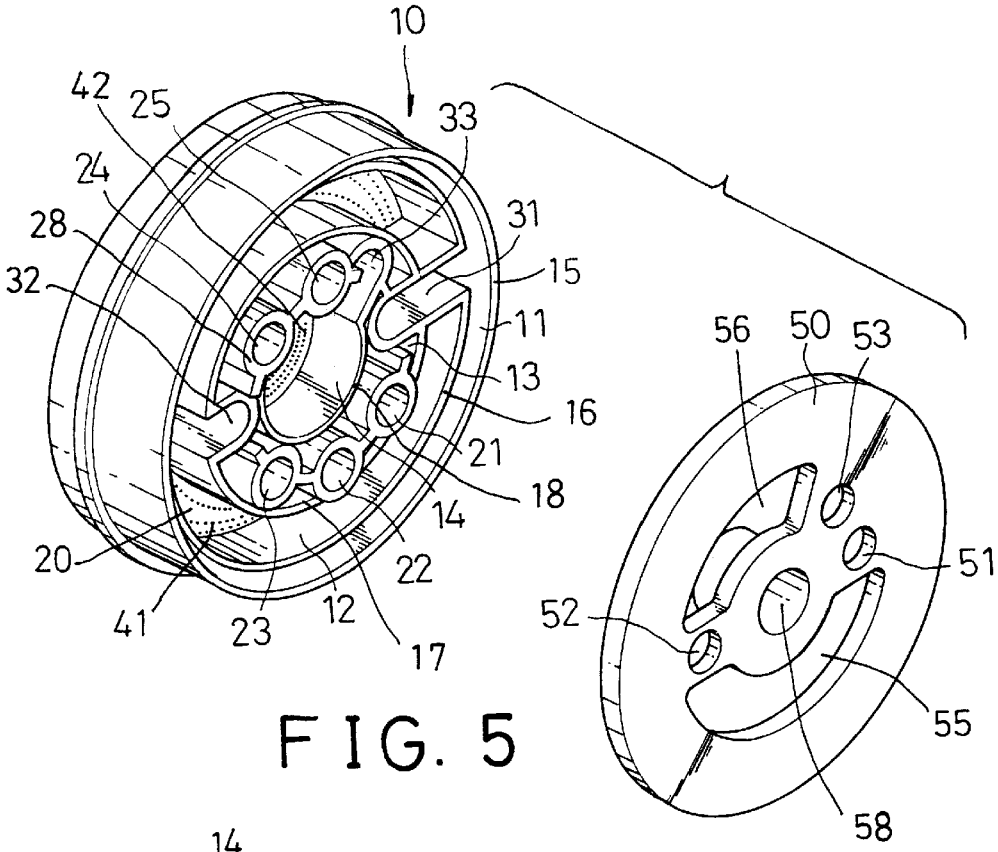
FIG. 5 is an exploded view of the discharge head.

Referring next to FIGS. 3–5 the housing 10 of the discharge head includes an annular channel 11 defined between an outer peripheral wall 15 and a peripheral partition 16 and includes an annular groove 12 defined between the peripheral partition 16 and a cylindrical fence 17, and includes an annular chamber 13 defined between the cylindrical fence 17 and a peripheral panel 18 which also defines a center space 14 in the center portion of the housing 10. The front portions of the peripheral wall 15 and the partition 16 are secured together by a number of radially extended ribs 19 (FIG. 3) which define a number of openings or peripheral openings 40 communicating with the channel 11 of the housing 10 for allowing the water to flow out of the housing 10 via the peripheral openings 40 of the housing 10. The housing 10 includes a front plate 20 (FIGS. 3, 5, 6) having the partition 16 and the fence 17 and the panel 18 extended rearward therefrom. The plate 20 includes a number of apertures 41 formed therein and communicating with the annular groove 12 of the housing, 10, and includes a number of orifices 42 formed therein and communicating with the center space 14 of the housing 10. The housing 10 includes a number of ports 21, 22, 23, 24, 25 each defined by a barrel 28 which may be aligned with the outlet 621 of the sprayer body 60 and for allowing the water to flow out through the ports 21–25.

The partition 16 includes a radially extended duct 31 formed or provided therein for coupling the channel 11 of the housing 10 to the outlet 621 of the sprayer body 60 and for allowing the water to flow out of the housing 10 via the openings 40. The partition 16 includes a conduit 32 extended radially therefrom for coupling the angular groove 12 of the housing 10 to the outlet 621 of the sprayer body 60 and for allowing the water to flow out of the housing 10 via the apertures 41 and the angular groove 12 of the housing 10. The peripheral panel 18 includes a passage 33 extended radially outward therefrom for coupling the center space 14 of the housing 10 to the outlet 621 of the sprayer body 60 and for allowing the water to flow out of the housing 10 via the orifices 42 and the center space 14 of the housing 10.

A cover 50 is secured to the rear portion of the housing 10 by such as ultrasonic welding processes and includes three holes 51, 52, 53 formed therein and communicating with the duct 31, the conduit 32 and the passage 33 respectively and includes two oblong or curved slots 55, 56 formed therein for receiving the ends or tips of the barrels 28. The plate 20 includes a bore 29 formed therein and the cover 50 includes a bore 58 formed therein for receiving the pivot shaft 80 and for allowing the housing 10 and the cover 50 to be rotatably coupled to the sprayer body 60 at the pivot shaft 80. The barrels 28 and the holes 51, 52, 53 and the curved slots 55, 56 are arranged in a circle corresponding to the outlet 621 of the sprayer body 60 for allowing the outlet 621 of the sprayer body 60 to be aligned with either the barrels 28 and the holes 51, 52, 53 and the curved slots 55, 56 when the housing 10 is rotated relative to the sprayer body 60.

It is to be noted that the openings 40 and the apertures 41 are separated from each other by the peripheral partition 16, and the orifices 42 may be coupled to the outlet 621 of the sprayer body 60 only with the passage 33, such that the water may be precisely guided to flow out through the ports 21–25 or the openings 40 or the apertures 41 or the orifices 42 of the housing 10.

Figure 6:
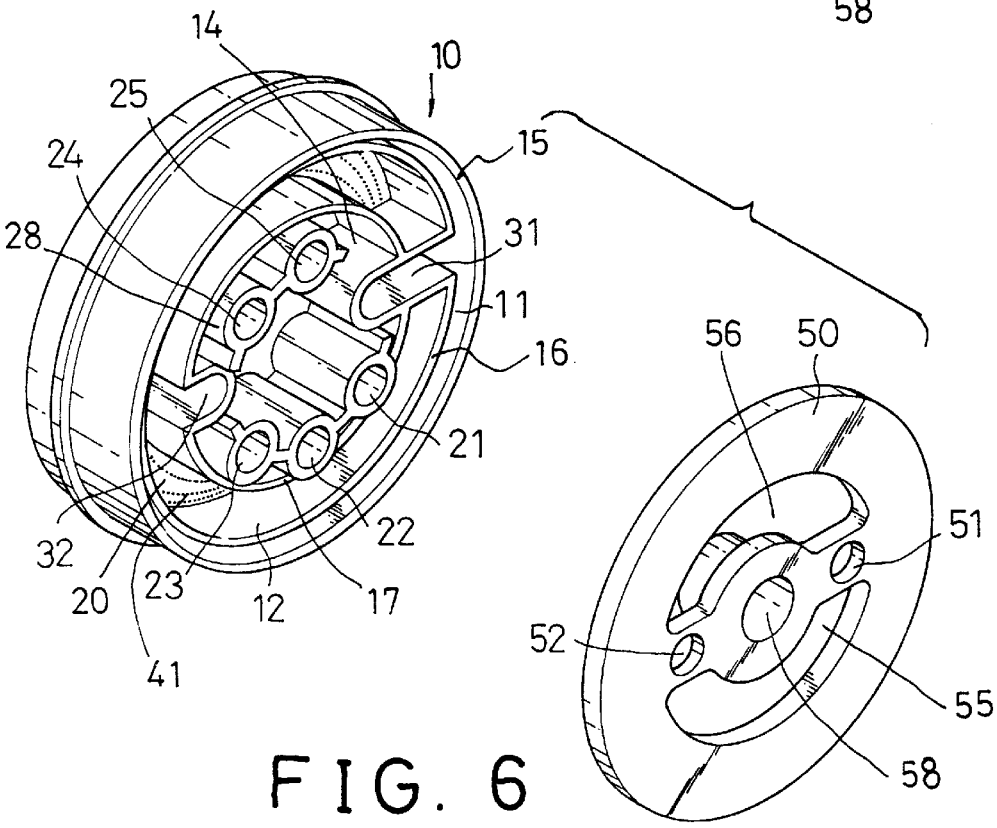
FIG. 6 is an exploded view illustrating another application of the discharge head.

Referring next to FIG. 6, without the peripheral panel 18, the water may also be guided to flow into the space 14 and then to flow out of the housing 10 via the orifices 42 of the housing 10. The water flowing into the space 14 also will not flows out through the openings 40, or the apertures 41 or the ports 21–25. The cover 50 includes only two holes 51, 52 for communicating with the duct 31 and the conduit 32 respectively.

As best shown in FIGS. 4–6, the peripheral partition 16 and the cylindrical fence 17 and the peripheral panel 18 include an identical height or flush with each other such that the cover 50 may be secured onto the peripheral partition 16 and the cylindrical fence 17 and the peripheral panel 18. The barrels 28 include a height greater than that of the peripheral partition 16 and the cylindrical fence 17 and the peripheral panel 18 or extended beyond the peripheral partition 16 and the cylindrical fence 17 and the peripheral panel 18 such that the ends or the tips of the barrels 28 may be engaged into the curved slots 55, 56 of the cover 50, and such that the cover 50 may be solidly secured to the housing 10. The engagement of the ends or the tips of the barrels 28 into the curved slots 55, 56 of the cover 50 may further prevent the cover 50 from rotating relative to the housing 10, in order to solidly secure the cover 50 to the housing 10. In addition, the peripheral wall 15 of the housing 10 includes a height equals to or greater than that of the barrels 28 such that the cover 50 may be solidly engaged in and retained in the peripheral wall 15 of the housing 10. The cover 50 may further be solidly secured to the housing 10 with the ultrasonic welding processes.

Accordingly, the sprayer head in accordance with the present invention includes a cover that may be solidly secured to the housing of the discharge head.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sprayer comprising:

a sprayer body including a front portion having an outlet formed therein and including a rear portion, a housing rotatably secured to said front portion of said sprayer body at a pivot shaft said housing including a rear portion having a peripheral wall and a peripheral partition extended therefrom and including a plurality of ports defined by a plurality of barrels respectively, and a cover secured to said rear portion of said housing and engaged with said peripheral partition of said housing said cover including at least one slot formed therein, wherein said barrels include a height greater than that of said peripheral partition of said housing and include an end extended beyond said peripheral partition of said housing and engaged into said at least one slot of said cover for solidly securing said cover to said housing.

2. The sprayer according to claim 1, wherein said housing includes an annular channel formed and defined between said peripheral wall and said peripheral partition, said housing includes an annular groove formed therein and defined by a cylindrical fence and said peripheral partition, said housing includes a front portion having a plurality of openings formed therein and communicating with said annular channel of said housing and having a plurality of apertures formed therein and communicating with said annular groove of said housing, said cover includes a first hole and a second hole formed therein, said peripheral partition includes a duct extended radially inward of said cover for coupling said openings and said annular channel of said housing to said outlet of said sprayer body, and said cylindrical fence includes a conduit communicating with said second hole of said cover for coupling said apertures and said annular groove of said housing to said outlet of said sprayer body, and for allowing the water to be guided to flow out of said housing via said openings and said apertures when said housing is rotated relative to said sprayer body.

3. The sprayer according to claim 2, wherein said housing further includes a space formed therein and defined by a peripheral panel, and includes an annular chamber defined between said cylindrical fence and said peripheral panel, said peripheral panel includes a passage formed therein, said cover includes a third hole formed therein and communicating with said passage of said peripheral panel for guiding the water to flow into said space via said third hole.

4. The sprayer according to claim 2, wherein said first hole and said second hole of said cover and said at least one slot of said cover are arranged in a circle for aligning with said outlet of said sprayer body when said housing is rotated relative to said sprayer body.

5. The spayer according to claim 2, wherein said peripheral wall of said housing includes a height no less than that of said barrels for receiving said cover in said peripheral wall of said housing.

6. The sprayer according to claim 2, wherein said at least one slot of said cover is a curved slot, said housing includes at least two of said barrels engaged into said curved slot of said cover.

* * * * *